US006446404B1

(12) United States Patent
Bassin

(10) Patent No.: US 6,446,404 B1
(45) Date of Patent: Sep. 10, 2002

(54) GLASS TILE SYSTEM AND METHOD OF INSTALLING GLASS TILE

(76) Inventor: Jeff Bassin, P.O. Box 6553, Vail, CO (US) 81658-6553

( * ) Notice: Subject to any disclaimer, the term of this patent is extended or adjusted under 35 U.S.C. 154(b) by 0 days.

(21) Appl. No.: 09/685,069

(22) Filed: Oct. 10, 2000

Related U.S. Application Data

(60) Provisional application No. 60/170,263, filed on Dec. 11, 1999.

(51) Int. Cl.[7] ..... E04F 13/14

(52) U.S. Cl. ..... 52/385; 52/391; 52/747.11; 52/506.05; 52/512; 52/396.1; 428/45; 428/49

(58) Field of Search ..... 52/385, 390, 391, 52/384, 506.05, 509, 512, 311.2, 308, 396.1, 747.11; 428/45, 49

(56) References Cited

U.S. PATENT DOCUMENTS 1,430,996 A * 10/1922 Horlin
2,178,535 A * 10/1939 Wilson
2,594,928 A * 4/1952 Horowitz
4,112,648 A * 9/1978 Suzuki et al.
4,557,096 A * 12/1985 Hovde
4,567,704 A 2/1986 Bernett et al.
4,736,559 A * 4/1988 Young
4,894,272 A 1/1990 Aisley
4,945,697 A 8/1990 Ott et al.
5,014,488 A 5/1991 Evangelos et al.
5,195,248 A 3/1993 Danico et al.
5,238,721 A 8/1993 Nakazawa
5,359,954 A * 11/1994 Kordelin
5,362,560 A 11/1994 Ehrhart et al.
5,375,385 A 12/1994 Feder
5,590,500 A 1/1997 McCue
5,766,754 A 6/1998 Fleck et al.
5,806,270 A * 9/1998 Solano et al.
5,916,102 A 6/1999 Peyton
6,341,461 B1 * 1/2002 Crowley et al.

* cited by examiner

*Primary Examiner*—Robert Canfield
(74) *Attorney, Agent, or Firm*—Lathrop & Gage L.C.

(57) ABSTRACT

A glass tile system and a method of installing glass tiles on a subsurface, such as a floor, wall, counter top, table top, or ceiling, by forming a grouting frame around the glass tiles with rods of solid flexible plastic or polymer material, which are removably fastened to the subsurface with a plurality of fasteners.

29 Claims, 5 Drawing Sheets

GLASS TILE SYSTEM AND METHOD OF INSTALLING GLASS TILE

This application is based upon a provisional application filed on Dec. 11, 1999 with a Ser. No. of 60/170,263, and is hereby incorporated by reference.

FIELD OF INVENTION

The present invention relates generally to a glass tile system and a method of installing glass tiles on a subsurface, such as a floor, wall, counter top, table top, or ceiling, by framing the glass tiles with rods of solid flexible plastic or polymer material, by forming a grouting frame around the glass tiles with rods of solid flexible plastic or polymer material, which are removably fastened to the subsurface with a plurality of fasteners.

BACKGROUND OF INVENTION

Use of glass tiles on subsurfaces such as floors, walls, ceilings, and counter-tops is uncommon because of safety concerns arising from the possibility that the tile will break or crack. Progress made in the art of manufacturing tempered and laminated glass has improved the safety of glass and has increased the desirability of using glass tiles on such subsurfaces in a home or office environment. The advantages of glass tile over other tile materials is that glass can be manufactured at various levels of transparency, and the colors in the glass tile can be altered during manufacturing and made uniform throughout the tile. Although the use of tempered and laminated glass tiles has greatly improved the safety of using glass tiles, precautions need to be taken when installing and using glass tiles to further reduce the likelihood of premature cracking and breaking. In particular, the glass tiles need to be installed in such a manner so that one tile does not rub or push against another tile or another rigid surface or material. Also, in the event that a glass tile does crack or break, it is necessary for safety reasons to make the tile easily removable and replaceable.

Using tiles made from ceramics, marbles, or other materials to cover floors, walls, and counter tops is well known and broadly practiced. There are two general methods of installation that are commonly used when installing tiles on subsurfaces, such as floors, walls and counter tops. The first method consists of adhering the tiles to the subsurface using cement and fine grain sand as the adhesive material, and using the cement and fine grain material as a grouting between the tiles. The second method consists of gluing the tiles to the subsurface, whereby one tile is placed immediately adjacent to the next tile, which requires no grouting between the tiles.

These two methods are disadvantageous when using glass tiles. In particular, the cement and fine grain sand grouting is inflexible and does not allow the tiles to move or flex, which increases the possibility that the glass tiles and grouting may crack or break. The method of gluing one tile immediately adjacent to the next tile also does not allow the tile to move or flex and can cause increased cracking and breaking along the adjacent edges of glass tiles. In addition, neither method allows for easy removal of tiles in the event that the tile is cracked or broken.

BRIEF DESCRIPTION OF DRAWINGS

The invention will be clearly understood by those skilled in the art by reference to the accompanying drawings, wherein the invention is depicted in an illustrative manner:

FIG. 3 also shows holes drilled in the grouting frame where fasteners are inserted to attach the grouting frame to the subsurface;

DETAILED DESCRIPTION OF THE PREFERRED EMBODIMENT

Figure 1:
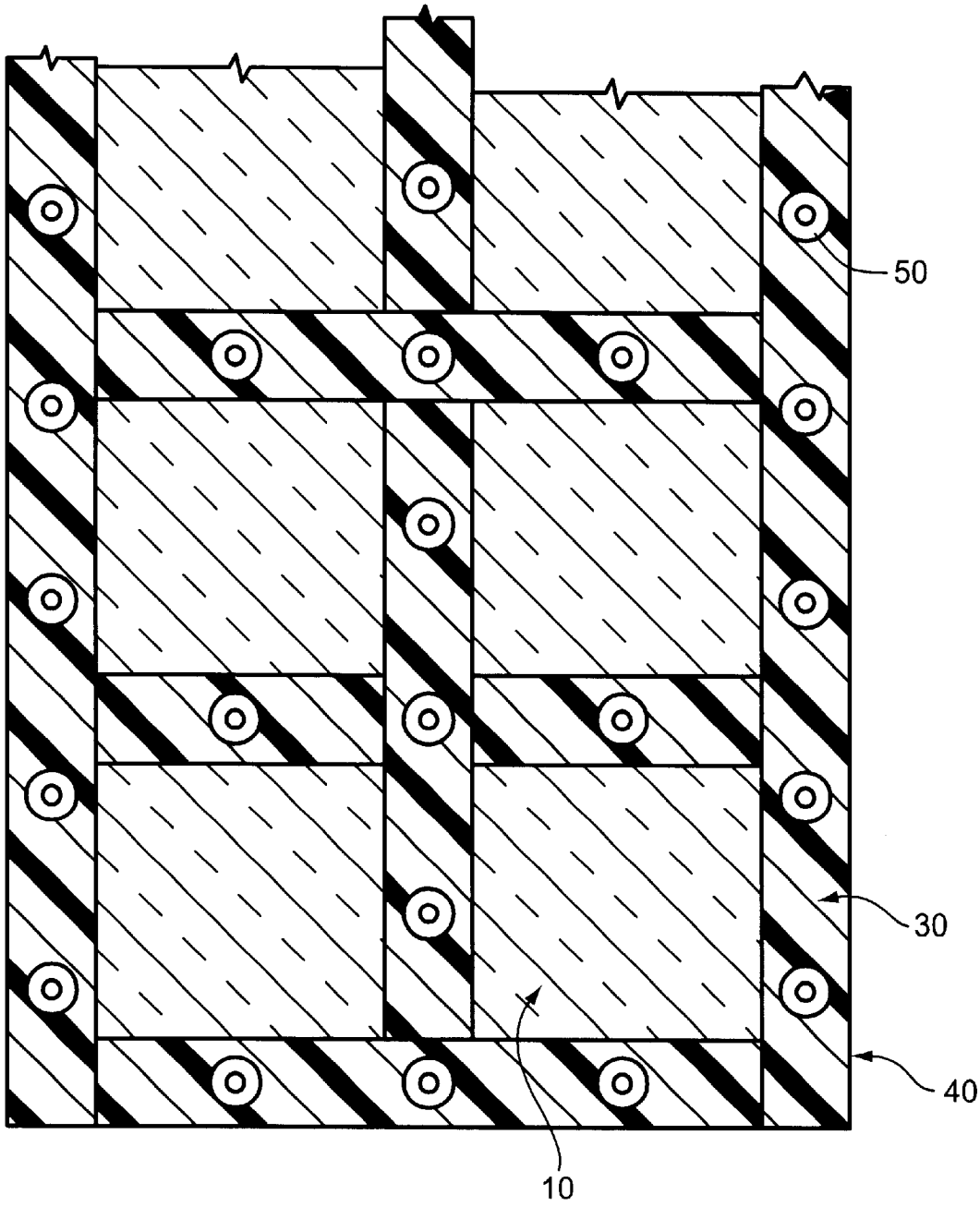
FIG. 1 is a top elevational view, showing a plurality of glass tiles, a grouting frame formed from rods of solid flexible plastic or polymer material, and a plurality of fasteners.
Figure 5:
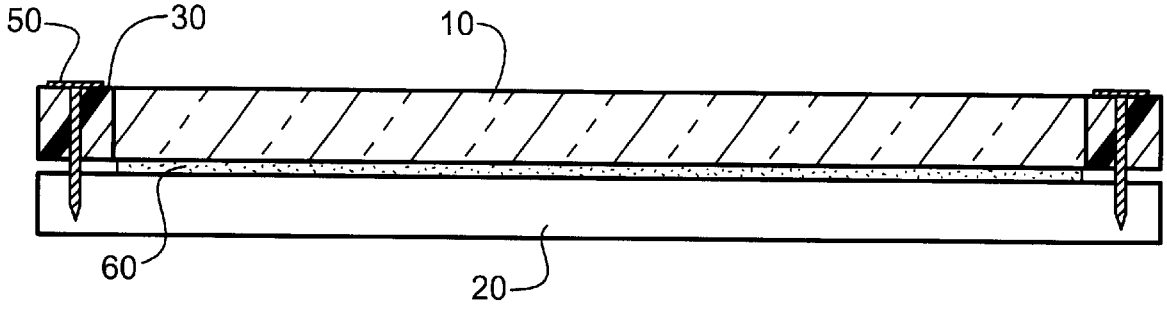
FIG. 5 is a sectional view showing the subsurface, rectangular shaped rods forming the grouting frame, a glass tile on the subsurface, and a plurality of fasteners attaching the grouting frame to the subsurface.
Figure 6:
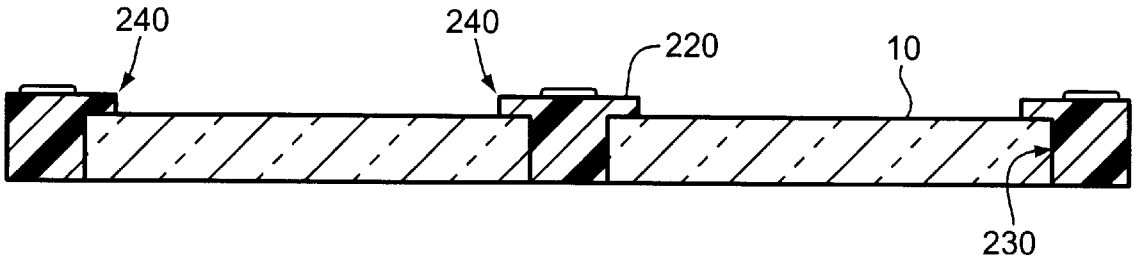
FIG. 6 is a sectional view showing "T" shaped and "L" shaped rods of solid flexible plastic or polymer material forming the grouting frame and showing the grouting frame overlaying glass tiles.

This method of installing glass tiles includes a subsurface 20 (FIG. 5), a plurality of glass tiles 10 (FIG. 1), rods of solid flexible plastic or polymer material 30 used to create a grouting frame 40 around each glass tile 10, and a plurality of fasteners 50 for attaching the rods of solid flexible plastic or polymer material to the subsurface 20. The rods of solid flexible plastic or polymer material 30 may be rectangular in shape when viewing a cross-section. Alternatively, the rods of solid flexible plastic or polymer material 30 may be "T" shaped or "L" shaped (FIG. 6) so that the top section 240 of the grouting frame 220 overlays the glass tiles 10. The method may include adhering the glass tiles 10 to the subsurface 20 using glue or other adhesive materials. The method may also include the application of a sealant to the peripheral edges of the glass tile and the inner surface of the frame formed by the rod of flexible plastic or polymer material such that moisture and other materials do not penetrate to the subsurface.

The preferred embodiment of the subsurface 20 (FIG. 1) is wood. Other subsurface materials such as metal, concrete, and plastics also could be used.

Figure 2:
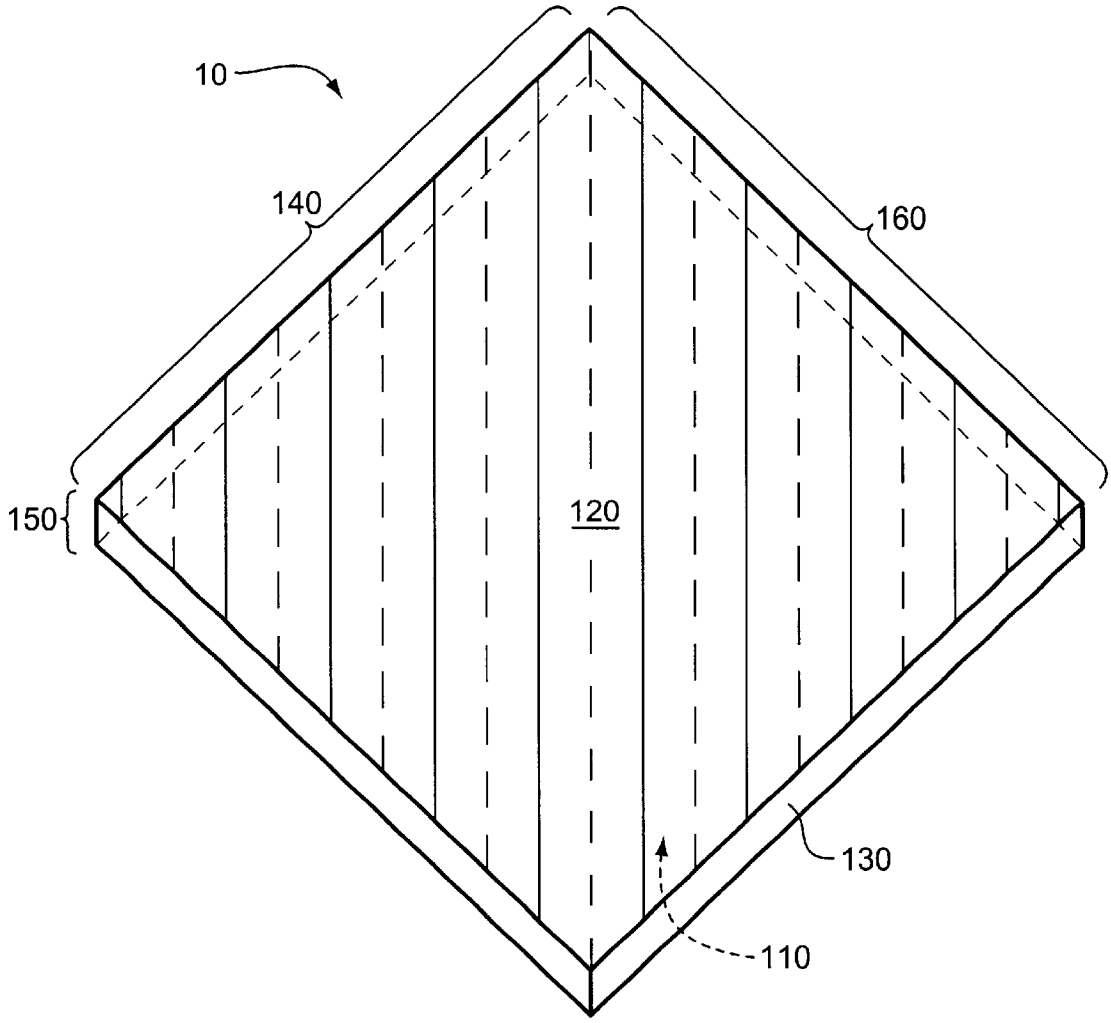
FIG. 2 is a perspective view of a glass tile showing the generally planer mounting surface, the generally planer display surface, the peripheral edges, and the length, width and thickness of the tile.

The preferred embodiment of the glass tile 10 is a tile manufactured from tempered and/or laminated glass, with the tile having a generally planer mounting surface 110 (FIG. 2), a generally planer top or display surface 120, and peripheral edges 130. The preferred thickness of the glass tile 150 is one-quarter (¼) inch or thicker. The preferred width 140 and length 160 of the glass tile is eight (8) inches or wider. This invention could be used for glass tiles having a length and width of less than 8 inches. The preferred embodiment is for glass tile 10 in a rectangular or square shape, but the method could be used for glass tile in other shapes, such as triangular or octagonal.

Figure 3:
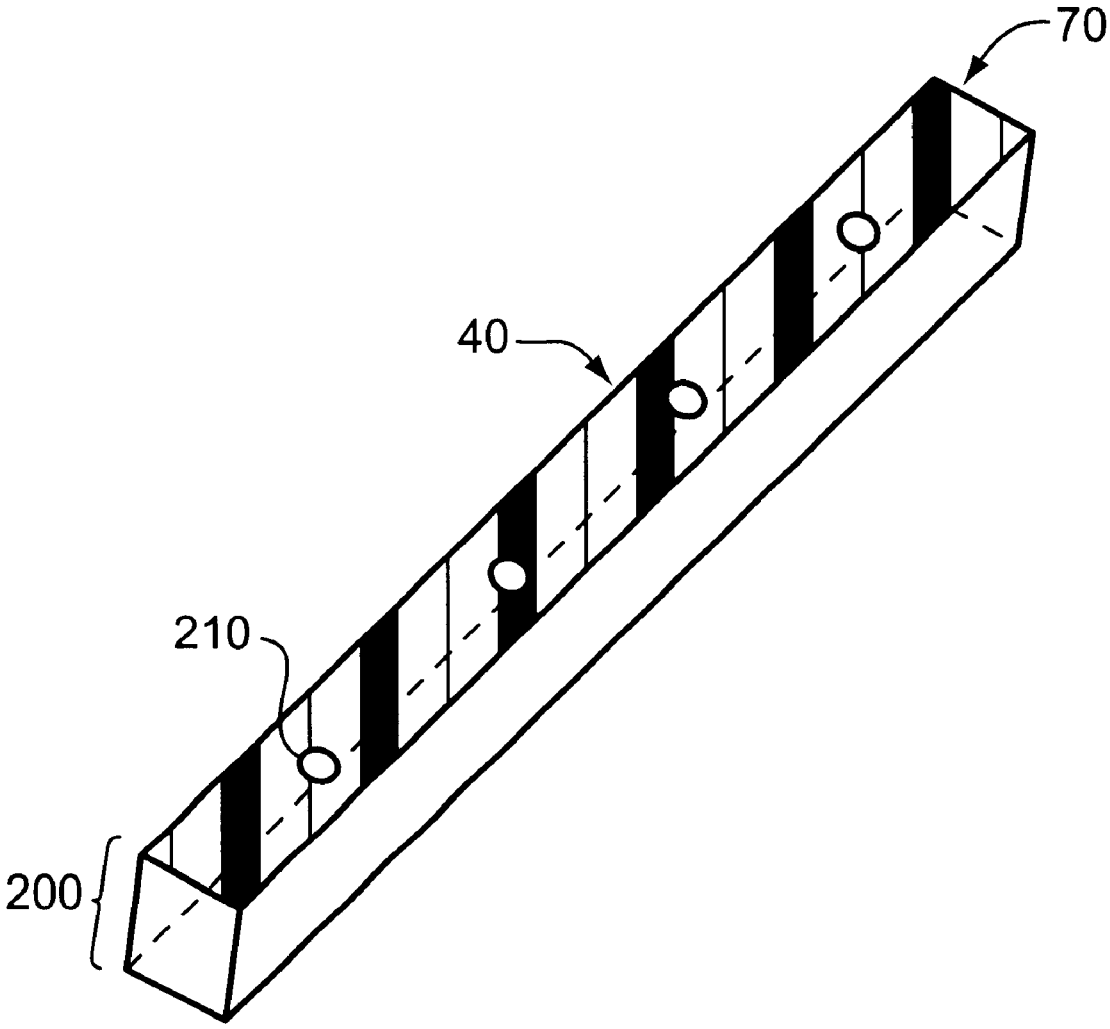
FIG. 3 is a perspective view showing a rectangular shaped rod of solid flexible plastic or polymer material.
Figure 4:
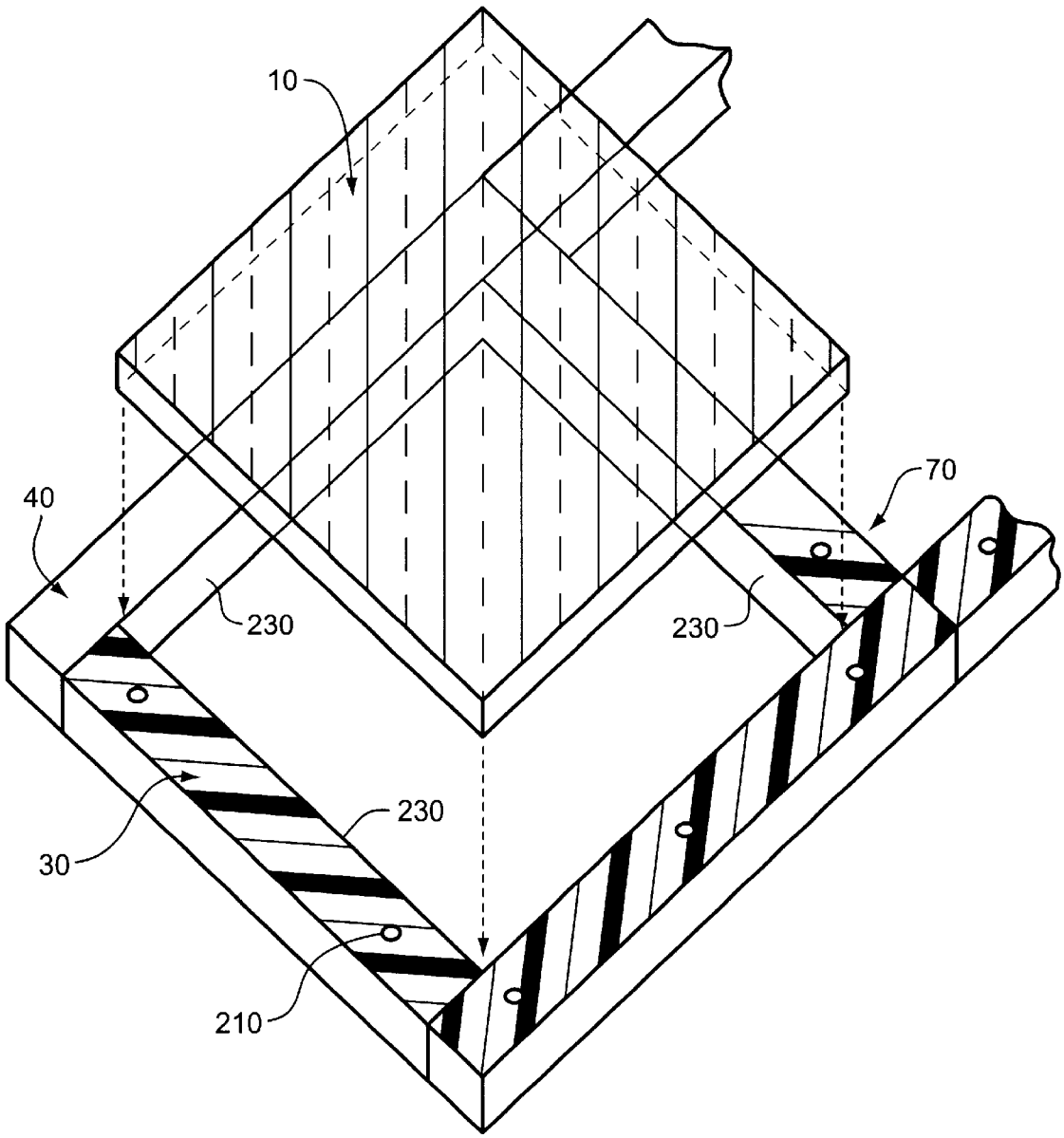
FIG. 4 is a perspective view showing the grouting frame formed by rectangular rods of solid flexible plastic or polymer material and the placement of glass tiles into the grouting frame.

The preferred material for the grouting frame 40 is ultra high molecular weight polyethylene having a thickness 200 (FIG. 3) equal to or greater than the thickness 150 of the glass tile 10. The ultra high molecular weight polyethylene provides the strength, wear, and flexibility needed for the grouting frame around the glass tiles 10. The ultra high molecular weight polyethylene also can be manufactured in a variety of colors that allows for added decorative affect. The grouting frame 40 also allows the glass tiles to be properly spaced to give a uniform finished appearance.

In the preferred embodiment of this invention, holes 210 (FIG. 3) are drilled through rectangular shaped ultra high weight polyethylene 30 at predetermined distances and locations. The holes are drilled in such a manner that the head of the fasteners 50 recedes into the polyethylene and the top of the fastener is level with the top surface 70 of the grouting frame 40. Predetermined lengths of the polyethylene 30 are attached to the subsurface 20 using a plurality of fasteners 50 so that the polyethylene 30 forms grouting frames 40 with inside dimensions equal in width and length to the width 140 and length 160 of the glass tiles 10 and that allows the peripheral edges 130 of the glass tiles 10 to contact the inside surface 230 of the grouting frame 40. The glass tile 10 is placed within the grouting frame 40 so that its generally planer mounting surface 110 contacts the subsurface 20 and the inside surfaces 230 of the grouting frame 40. A sealant material may be applied to the peripheral edges of the glass tile to prevent moisture and other foreign matter from penetrating the surface to the subsurface 20.

In an alternative embodiment of this invention, holes 210 (FIG. 3) are drilled through "T" and/or "L" shaped ultra high weight polyethylene 30 at predetermined distances and locations. The holes are drilled in such a manner that the head of the fasteners 50 recedes into the polyethylene and the top of the fastener is level with the top surface 70 of the grouting frame 40. Predetermined lengths of the polyethylene 30 are attached to the subsurface 20 using a plurality of fasteners 50 so that the polyethylene 30 forms a grouting frame 40 such that the top section 240 of the grouting frame 220 overlays (FIG. 6) the peripheral edges of the glass tiles 10. The glass tile 10 is placed within the grouting frame 40 so that its generally planer mounting surface 110 contacts the subsurface 20 and the grouting frame overlays the peripheral edges of the glass tiles 10. A sealant material may be applied to the peripheral edges of the glass tile to prevent moisture and other foreign matter from penetrating the surface to the subsurface 20.

In the event it becomes necessary to remove a glass tile 10, the grouting frame 40 around the individual glass tile 10 can be removed allowing for easy removal and replacement of the glass tile 10 without damaging the surrounding glass tiles 10 or the grouting frame 40.

Although this invention relates to the installation of glass tiles, the method can be used for other types of tile, including ceramic tiles and tiles made of plastic or polymer material.

I claim:

1. A glass tile system comprising:

a subsurface;

a grouting frame formed over the subsurface using rods of solid flexible ultra high molecular weight polyethylene;

said grouting frame having an inside surface, a top surface, and a bottom surface;

said bottom surface of the grouting frame placed adjacent to the subsurface;

a plurality of glass tiles to be installed on the subsurface;

said plurality of glass tiles comprising all of the glass tiles for the glass tile system;

said plurality of glass tiles having a generally planar mounting surface, a generally planar top surface, and peripheral edges placed within the grouting frame such that the generally planar mounting surface of each of the plurality of glass tiles is in contact with the subsurface and the peripheral edges of said glass tiles contact the inside surface of said grouting frame; and a plurality of fasteners for removably fastening the grouting frame to the subsurface such that said glass tiles can be easily replaced.

2. The glass tile system recited in claim 1, wherein the rods of solid flexible ultra high molecular weight polyethylene are rectangular in shape when viewing a cross-section of said rods.

3. The glass tile system recited in claim 1, wherein the rods of solid flexible ultra high molecular weight polyethylene are "T" shaped when viewing a cross-section of said rods;

said "T" shaped rods have a top section and a lower section; and said grouting frame is installed in a manner such that a top section of the "T" shaped rods overlays the peripheral edges of said glass tiles.

4. The glass tile system recited in claim 1, wherein the rods of solid flexible ultra high molecular weight polyethylene are "L" shaped when viewing a cross-section of said rods;

said "L" shaped rods having a top section and a lower section; and said grouting frame is installed in a manner such that a top section of the "L"shaped rods overlays the peripheral edges of said glass tiles.

5. The glass tile system recited in claim 1, Wherein a plurality of holes are drilled into the grouting frame for inserting said fasteners.

6. The glass tile system recited in claim 5, wherein the plurality of holes are drilled in such a manner that the head of each of said fasteners recedes into the grouting frame and the top of said fasteners is level with the top surface of said grouting frame.

7. The glass tile system recited in claims 1, wherein said glass tiles are at least one quarter inch in thickness.

8. The glass tile system recited in claim 1, wherein said glass tiles are at least eight inches in width and length.

9. The glass tile system recited in claim 1, wherein the thickness of the grouting frame is equal to or greater than the thickness of said glass tiles.

10. The glass tile system recited in claim 1, wherein said glass tiles are laminated glass.

11. The glass tile system recited in claim 1, wherein said glass tiles are tempered glass.

12. The glass tile system recited in claim 1, wherein a sealant is applied at the point where the peripheral edges of said glass tiles contact the inside surface of the grouting frame to prevent moisture and other foreign matter from penetrating to the subsurface.

13. The glass tile system recited in claim 1, wherein said glass tiles are adhered to the subsurface.

14. A method for installing a plurality of glass tiles on a subsurface, comprising:

forming a grouting frame over the subsurface using rods of solid flexible material;

said grouting frame comprising an inside surface, a top surface, and a bottom surface;

said bottom surface of the grouting frame placed adjacent to the subsurface;

placing a plurality of glass tiles having a generally planar mounting surface, a generally planar top surface, and peripheral edges into said grouting frame such that the generally planar mounting surface of each of the plurality of glass tiles contacts the subsurface and the peripheral edges of said glass tiles contact the inside surface of said grouting frame;

said plurality of glass tiles comprises all glass tiles to be installed on the subsurface; and removably fastening the grouting frame to the subsurface using a plurality of fasteners such that said plurality of glass tiles can be easily replaced.

15. The method as recited in claim 14, wherein the grouting frame is formed from solid flexible plastic material.

16. The method as recited in claim 14, wherein the grouting frame is formed from solid flexible polymer material.

17. The method as recited in claim 14, wherein the grouting frame is formed from ultra high molecular weight polyethylene.

18. The method as recited in claim 14, wherein the rods of solid flexible material forming the grouting frame are rectangular in shape when viewing a cross-section of said rods.

19. The method as recited in claim 14, wherein the rods of solid flexible material forming the grouting frame are "T" shaped when viewing a cross-section of said rods;

said "T" shaped rods having a top section and a lower section; and said grouting frame is installed in a manner such that the top section of the "T"shaped rods overlays the peripheral edges of said glass tiles.

20. The method as recited in claim 14, wherein the rods of solid flexible material forming the grouting frame are "L" shaped when viewing a cross-section of said rods;

said "L" shaped rods having a top section and a lower section; and said grouting frame is installed in a manner such that the top section of the grouting frame overlays the peripheral edges of said glass tiles.

21. The method as recited in claim 14, wherein a plurality of holes are drilled into the grouting frame for inserting said fasteners.

22. The method as recited in claim 21, wherein the plurality of holes are drilled in such a manner that the head of each of said fasteners recedes into the grouting frame and the top of said fasteners is level with the top surface of said grouting frame.

23. The method as recited in claim 14, wherein said glass tiles are at least one-quarter inch in thickness.

24. The method as recited in claim 14, wherein said glass tiles are at least eight inches in width and length.

25. The method as recited in claim 14, wherein the thickness of the grouting frame is equal to or greater than the thickness of said glass tiles.

26. The method as recited in claim 14, wherein said glass tiles are laminated glass.

27. The method as recited in claim 14, wherein said glass tiles are tempered glass.

28. The method as recited in claim 14, wherein a sealant is applied at the point where the peripheral edges of said glass tiles contact the inside surface of the grouting frame to prevent moisture and other foreign matter from penetrating to the subsurface.

29. The method as recited in claim 14, wherein said glass tiles are adhered to the subsurface.

* * * * *